US006482579B2

(12) United States Patent
Kapecki et al.

(10) Patent No.: US 6,482,579 B2
(45) Date of Patent: Nov. 19, 2002

(54) METHOD OF PROCESSING COLOR NEGATIVE ELEMENTS

(75) Inventors: Jon A. Kapecki, Rochester, NY (US); Harry J. Price, Webster, NY (US); David M. Braitsch, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/777,112

(22) Filed: Feb. 5, 2001

(65) Prior Publication Data

US 2002/0051946 A1 May 2, 2002

Related U.S. Application Data

(63) Continuation-in-part of application No. 09/657,022, filed on Sep. 7, 2000.

(51) Int. Cl.[7] ..... G03C 7/42
(52) U.S. Cl. ..... 430/430; 430/393
(58) Field of Search ..... 430/393, 430

(56) References Cited

U.S. PATENT DOCUMENTS

| | | | | | |
|---|---|---|---|---|---|
| 3,591,380 | A | * | 7/1971 | Ohkubo et al. | 430/393 |
| 4,264,716 | A | | 4/1981 | Vincent et al. | 430/380 |
| 4,546,068 | A | | 10/1985 | Kuse | 430/375 |
| 4,892,804 | A | | 1/1990 | Vincent et al. | 430/380 |
| 4,921,779 | A | | 5/1990 | Cullinan et al. | 430/379 |
| 4,933,266 | A | | 6/1990 | Stephen et al. | 430/393 |
| 4,975,356 | A | | 12/1990 | Cullinan et al. | 430/393 |
| 5,037,725 | A | | 8/1991 | Cullinan et al. | 430/372 |
| 5,061,608 | A | | 10/1991 | Foster et al. | 430/461 |
| 5,523,195 | A | | 6/1996 | Darmon et al. | 430/393 |
| 5,536,625 | A | * | 7/1996 | Buchanan et al. | 430/393 |
| 5,552,264 | A | | 9/1996 | Cullinan et al. | 430/461 |
| 5,693,456 | A | | 12/1997 | Foster et al. | 430/461 |
| 5,783,376 | A | * | 7/1998 | Gordon et al. | 430/393 |
| 6,033,834 | A | | 3/2000 | Foster | 430/398 |
| 6,096,487 | A | | 8/2000 | Foster | 430/430 |

* cited by examiner

*Primary Examiner*—Hoa Van Le
(74) *Attorney, Agent, or Firm*—J. Lanny Tucker

(57) ABSTRACT

Color negative photographic elements can be effectively processed to provide negative color images using bleaching or bleach-fixing compositions in which the primary bleaching agent is a ferric complex of 1,3-propylenediaminetetraacetic acid or a salt thereof. Any potential precipitation of the bleaching agent is inhibited by the presence of at least 0.005 mol/l of an organic polyphosphonic acid, an aminopolysuccinic acid, or a polycarboxylic acid containing at least one hydroxy group as a compound. This compound can be added directly to the bleaching or bleach-fixing composition or introduced from carryover from a previous photoprocessing step.

12 Claims, No Drawings

METHOD OF PROCESSING COLOR NEGATIVE ELEMENTS

RELATED APPLICATIONS

This is a Continuation-in-part application of U.S. Ser. No. 09/657,022 filed Sep. 7, 2000, by Price and Henry.

FIELD OF THE INVENTION

This invention relates to improved methods for providing color negative images from color negative photographic silver halide elements. Thus, this invention relates to the photographic industry and to photochemical processing in particular.

BACKGROUND OF THE INVENTION

The conventional image-forming process of silver halide photography includes imagewise exposure of a color photographic silver halide recording material to acetonic radiation (such as visible light), and the eventual manifestation of a useable image by wet photochemical processing of that exposed material. A fundamental step of photochemical processing is the treatment of the material with one or more developing agents to reduce silver halide to silver metal. A useful color image consists of one or more images in organic dyes produced from an oxidized developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved with an oxidizing agent, commonly known as a bleaching agent.

Color photographic elements can be designed to provide either color negative or color positive images. For example, color negative images can be produced by imaging and appropriate color processing of imagewise exposed color negative films. The typical commercial processing methods for such films generally include color development, bleaching, fixing and final rinsing or stabilizing steps (for example, the conventional Process C-41 method commercialized by Eastman Kodak Company).

The most common bleaching agents for color photographic processing are complexes of ferric ion and various organic chelating ligands (such as aminopolycarboxylic acids), of which there are hundreds of possibilities, all with varying bleaching activities and biodegradability. Common organic chelating ligands used as part of bleaching agents for color negative film processing include ethylenediaminetetraacetic acid (EDTA), 1,3-propylenediaminetetraacetic acid (PDTA) and nitrilotriacetic acid (NTA).

Ferric complexes with PDTA or its salts are excellent bleaching agents can be used in processing color negative films in the commercial Process C-41 processing method.

The bleaching agents tend to form thick, gelatinous precipitates in the presence of inorganic phosphate ions. Such ions are common in various photoprocessing compositions, and may be present in the color developing compositions that are used in processing color negative materials. Phosphate ions in these compositions are apparently carried over into the bleaching solution. If the PDTA-based bleaching agents are present, the undesirable precipitates are formed.

One way to solve this problem is to remove the phosphate ions from the various processing compositions so carryover solutions do not contaminate the bleaching composition. It has not been possible to remove sufficient inorganic phosphate ions from all of those compositions.

Thus, there remains a need for PDTA bleaching compositions that are free of precipitates in the presence of inorganic phosphate ions.

SUMMARY OF THE INVENTION

The problems with known photographic photoprocessing compositions and methods are overcome with the use of a method of photographic processing comprising bleaching an imagewise exposed and color developed color negative photographic silver halide element with a photographic bleaching composition or a photographic bleach-fixing composition that in aqueous form has a pH of at least 4 and comprises:

a) at least 0.01 mol/l of a bleaching agent that comprises ferric ion chelated with 1,3-propylenediaminetetraacetic acid or a salt thereof, and b) at least 0.005 mol/l of an organic polyphosphonic acid, an aminopolysuccinic acid, or a polycarboxylic acid containing at least one hydroxy group as a compound to prevent bleaching agent precipitation.

The advantages of this invention are several. The color negative photographic elements can be processed using a highly effective and inexpensive photographic bleaching agent without the problem of precipitation if inorganic phosphate ions are present. Because a more effective bleaching agent can be used, less of it is discharged to the environment in effluent. Moreover, other components in the bleaching or bleach-fixing composition may be lessened, thereby further lowering costs and environmental impact.

The precipitate problem is overcome by having certain bleaching agent precipitation preventing compounds in the bleaching or bleach-fixing composition. These compounds can be introduced directly into the bleaching or bleach-fixing composition (for example during manufacturing or use as a separate liquid or solid additive), or indirectly by carryover from prior processing solutions, such as a photographic color developing solution. Generally, the bleaching agent precipitation preventing compounds used in the practice of this invention are present in the bleaching or bleach-fixing composition in an amount of at least 50% of the concentration of the inorganic phosphate ions that can be 0.0005 mol/l or more in that composition. Phosphate ions can be introduced directly or indirectly into the bleaching or bleach-fixing composition as well as the bleaching agent precipitation prevention compounds.

DETAILED DESCRIPTION OF THE INVENTION

The method of this invention can be used to provide a color negative image in what are known in the art as color negative photographic elements. After such elements are imagewise exposed and subjected to color development, they are bleached and fixed to remove silver, and otherwise processed using conventional steps and compositions (such as using conventional Process C-41 conditions and solutions).

Photographic bleaching or bleach-fixing is carried out in one or more bleaching and/or bleach-fixing steps using a particularly desirable bleaching agent that is a ferric complex of 1,3-propylenediaminetetraacetic acid (PDTA), or a suitable ammonium or alkali metal salt thereof. This is the primary bleaching agent in the bleaching or bleach-fixing composition meaning that it comprises at least 50 mol % of all ferric complex bleaching agents in the composition. Preferably, the primary bleaching agent comprises at least 70 mol % of the total iron complex bleaching agents, and more preferably, it is the only ferric complex bleaching agent.

Generally, the primary bleaching agent is present in the bleaching or bleach-fixing compositions in an amount of at least 0.01 mol/l, and preferably in an amount of from about 0.1 to about 0.4 mol/l.

The bleaching and bleach-fixing compositions can also include one or more additional biodegradable or one or more non-biodegradable ferric-ligand complexes as long as they are not the "primary" bleaching agents. Preferably, the additional chelating ligands used in such complexes are biodegradable. There may also be present minor quantities of non-biodegradable bleaching agents of which there are hundreds of possibilities known in the art.

There are many known classes of biodegradable aminopolycarboxylic acid or polycarboxylic acid chelating ligands that can be used to form biodegradable ferric ion bleaching agents. One class of such chelating ligands includes iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl and t-butyl). Particularly useful alkyliminodiacetic acids are methyliminodiacetic acid (MIDA) and ethyliminodiacetic acid (EIDA), and MIDA is the most preferred. These ligands can be used in the free acid form or as alkali metal (for example, sodium and potassium) or ammonium salts.

Still another useful class of biodegradable chelating ligands are aminodisuccinic and aminomonosuccinic acids (or salts thereof) including ethylenediaminedisuccinic acid (EDDS) and ethylenediaminemonosuccinic acid (EDMS). Aminodisuccinic acids are compounds having one or more nitrogen atoms (preferably two or more nitrogen atoms) and preferably two of the nitrogen atoms are bonded to a succinic acid group (or salt thereof). Preferred chelating ligands have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms (meaning first or last nitrogens in the compounds). More details about such chelating ligands including representative chelating ligands are provided in U.S. Pat. No. 5,652,085 (noted above), incorporated herein by reference.

Aminomonosuccinic acids (or salts thereof) are compounds having at least one nitrogen atom to which a succinic acid (or salt) group is attached. Otherwise, the compounds are defined similarly to the aminodisuccinic acids described above. U.S. Pat. No. 5,652,085 (noted above) also provides more details about such compounds, particularly the polyamino monosuccinic acids. EDMS is preferred in this class of chelating ligands.

Still other useful biodegradable ferric ion chelating ligands include, but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid and tartaric acid.

The iron salts used to form bleaching agents in the practice of this invention are generally ferric ion salts which provide a suitable amount of ferric ion for complexation with the ligands defined below. Useful ferric salts include, but are not limited to, ferric nitrate nonahydrate, ferric ammonium sulfate, ferric oxide, ferric sulfate and ferric chloride. Ferric nitrate is preferred. These salts can be provided in any suitable form and are available from a number of commercial sources.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

If up to 50 mol % of the total iron-complex bleaching agents are non-biodegradable, such bleaching agents can be any of hundreds of possible ferric ion complexes that are known in the considerable publications for this art. Particularly useful bleaching agents of this type are ethylenediaminetetraacetic acid, diethylenetriaminepentaacetic acid, 1,4-cyclohexanediaminetetraacetic acid and hydroxyethylethylenediaminetriacetic acid.

It is not necessary that the ferric ion and the chelating ligand(s) be present in the bleaching or bleach-fixing composition in stoichiometric proportions. It is preferred, however, that the molar ratio of the total chelating ligands (at least 50 mol % PDTA) to ferric iron be from about 1:1 to about 5:1. In a more preferred embodiment, the ratio is about 1:1 to about 2.5:1 moles of total chelating ligands per mole of ferric ion.

Generally speaking, ferric ions are present in the bleaching or bleach-fixing composition in an amount of at least 0.01 mol/l, and preferably at least 0.1 mol/l, and generally up to 1 mol/l, and preferably up to 0.25 mol/l.

The bleaching agents are generally provided for use in the present invention by mixing a ferric ion compound (typically a water-soluble salt) with the desired chelating ligands (including PDTA) in an aqueous solution. The pH of the solution is adjusted using appropriate acids or bases.

An essential component of the bleaching or bleach-fixing composition is an organic polyphosphonic acid (or ammonium or alkali metal salts thereof), an aminopolysuccinic acid (or ammonium or alkali metal salts thereof, or a polycarboxylic acid containing at least one hydroxy group (or ammonium or alkali metal salts thereof) as a compound to prevent bleaching agent precipitation (that is, precipitation of Fe-PDTA). These bleaching agent precipitation prevention "additives" are present generally in uncomplexed form, meaning that they are not present as ferric complexes.

Useful organic polyphosphonic acids are organic compounds having at least two phosphonic acid (or equivalent salts) groups, and include but are not limited to, amino-N, N-dimethylenephosphonic acids (or equivalent salts), aminopolyphosphonic acids such as aminodiphosphonic acids (or equivalent salts), N-acylaminodiphosphonic acids (or equivalent salts), and hydroxyalkylidene diphosphonic acids (or equivalent salts). Representative compounds of these various classes are shown for example in U.S. Pat. No. 4,264,716 (Vincent et al), U.S. Pat. No. 4,892,804 (Vincent et al), U.S. Pat. No. 4,546,068 (Kuse), and *Research Disclosure,* publication 20405 (April, 1981), publication 18837 (December 1979), publication 18826 (December 1979), and publication 13410 (June, 1975), all incorporated herein by reference.

Preferred classes of organic polyphosphonic acid compounds include aminopolyphosphonic acids and hydroxy-substituted polyphosphonic acids.

Representative compounds of this type are 1-hydroxyethylidene-1,1-diphosphonic acid, ethylenediaminetetra(methylenephosphonic acid), morpholinomethanediphosphonic acid, hexamethylenediaminetetra(methylenephosphonic acid), diethylenetriaminepenta(methylenephosphonic acid), and aminotri(methylenephosphonic acid).

Aminopolysuccinic acids that are be used in this invention include but are not limited to an organic acids having at least one amino group and two or more succinic acid groups. Examples of such compounds include iminodisuccinic acid, EDDS (defined above) and similar compounds described in U.S. Pat. No. 5,652,085 (noted above).

Polycarboxylic acids having at least two carboxy groups and at least one hydroxy group include organic acids having at least two carboxy groups and at least one hydroxy group.

Representative compounds of this type are 2-hydroxy-1, 3-propylenediaminetetraacetic acid, hydroxyaspartic acid, citric acid, tartaric acid, malic acid, citramalic acid, hydroxymalonic acid, and dihydroxyfumaric acid.

These compounds that are used to prevent precipitation of Fe-PDTA can be used in mixtures, but are generally present in an amount of at least 0.005 mol/l, and preferably from about 0.01 to about 0.5 mol/l. These compounds can be readily prepared using known starting materials and synthetic procedures, or obtained from a number of commercial sources including Dow Chemical Company, Aldrich Chemical Co, and Solutia Inc. The precipitation prevention compounds can be provided in any suitable liquid or solid form.

Bromide or iodide ions or both may be present in the bleaching or bleach-fixing composition. Such ions are provided in the form of water-soluble salts including ammonium, alkali metal and alkaline earth metal salts. The preferred salts are sodium, potassium and ammonium salts. Preferably, ammonium ions comprise at least 50 mol % of the total cations in the composition.

The bleaching or bleach-fixing composition can also include other addenda that may be useful in either working strength bleaching solutions, concentrates, replenishers or regenerators, such as buffers, optical brighteners, whitening agents, preservatives (such as sulfites), metal sequestering agents, anti-scummning agents, organic antioxidants, biocides, anti-fungal agents, and anti-foam agents.

Useful buffers include acetic acid, propionic acid, succinic acid, maleic acid, malonic acid, tartaric acid, and other water-soluble aliphatic or aromatic carboxylic acids known in the art. Acetic acid and succinic acid are preferred. Inorganic buffers, such as borates, hydrobromic acid and carbonates can be used if desired. The bleaching or bleach-fixing compositions are preferably aqueous solutions having a pH of from about 4 to about 8. A preferred pH is in the range of from about 5 to about 7. Alternatively, the compositions can be formulated as solids materials in the form of dry powders, granules or tablets that upon dissolution in water have the noted pH.

The photographic bleaching compositions useful in this invention can also be photographic bleach-fixing compositions that include one or more fixing agents as well as the noted bleaching agents. Useful fixing agents are described below. Preferably, however, the photographic bleaching compositions contain no photochemically active amount of a fixing agent, and thusly are not considered photographic bleach-fixing compositions.

A photographic fixing composition is generally used at least after the bleaching step. If desired, more than one fixing step can be used, and one or more of those steps can precede the bleaching step as long as one fixing step follows the bleaching step. One or more intermediate washing steps can separate the bleaching and fixing steps if desired.

A useful photographic fixing composition is an aqueous composition containing one or more photographic fixing agents, with or without fixing accelerators. Useful fixing agents include, but are not limited to, sulfites, thiocyanates, thiosulfates, and mixtures thereof. Fixing accelerators include, but are not limited to, thioethers, and mercaptotriazoles. The fixing agents can be present as thiosulfate or thiocyanate salts (that is alkali metal or ammonium salts) as is well known in the art. Mixtures of at least one thiosulfate and at least one thiocyanate may be particularly useful in some methods of the invention, especially when more rapid fixing is desired.

The photographic fixing solution can include other addenda commonly useful in such solutions for various purposes, including buffers, metal sequestering agents, and electron transfer agents.

In some embodiments, the photographic fixing composition can include one or more uncomplexed aminodisuccinic acids that have one or more nitrogen atoms, and one or more of the nitrogen atoms are bonded to one or two succinic acid groups (or salts thereof) as described in U.S. Pat. No. 6,013,422 (Price). Such compounds include both monoaminodisuccinic acids (or salts thereof and polyaminodisuccinic acids (or salts thereof) as described above for the second chelating ligand.

Such compounds have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms (meaning first or last nitrogens in the compounds). More details about such compounds and their preparation are provided in U.S. Pat. No. 5,652,085 (noted above).

Representative compounds of this type that are used as uncomplexed "additives" in the fixing composition include, but are not limited to, ethylenediamine-N,N'-disuccinic acid (EDDS), diethylenetriamine-N,N"-disuccinic acid, triethylenetetraamine-N,N'"-disuccinic acid, 1,6-hexamethylenediamine-N,N'-disuccinic acid, tetraethylenepentamine-N,N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, methyliminodisuccinic acid, and iminodisuccinic acid (IDSA). EDDS and IDSA are preferred. Racemic mixtures of the uncomplexed additives can be used, or essentially pure isomers can be used. For example, the [S,S] isomer of EDDS may be useful in this manner.

Other uncomplexed biodegradable or non-biodegradable polycarboxylic acids (for example, citric acid, nitrilotriacetic acid, tartaric acid, or ethylenediaminetetraacetic acid) can be included in the fixing composition as well as long as sufficient aminodisuccinic acid(s) are present to achieve the desired reduction in residual iron during fixing.

The amount of fixing agent useful in the photographic fixing composition is well known in the art, and is generally at least 0.5 mol/l. Other details about fixing solutions are also well known in the art to a skilled photographic processing chemist. The compositions can include but are not limited to, buffers, biocides, anti-fungal agents, optical brighteners, preservatives (such as sulfites), organic antioxidants, anti-scumming agents, and sequestering agents.

Other details of fixing compositions not explicitly described herein are considered well known in the art, and are described for example, in *Research Disclosure* publication 38957 (noted below), and publications noted therein in paragraph XX(B), U.S. Pat. No. 5,424,176 (Schmittou et al.), U.S. Pat. No. 4,839,262 (noted above), U.S. Pat. No. 4,921,779 (noted above), U.S. Pat. No. 5,037,725 (noted above), U.S. Pat. No. 5,523,195 (noted above), U.S. Pat. No. 5,552,264 (noted above), U.S. Pat. No. 6,013,424 (Schmittou et al.), U.S. Pat. No. 6,022,676 (Schmittou et al.), U.S. Pat. No. 6,087,077 (Schmittou et al.), and U.S. Pat. No. 6,159,669 (Schmittou et al.), all of which are incorporated herein by reference for their teaching of fixing compositions.

The bleaching or bleach-fixing compositions of this invention can be used to process a suitable color negative photographic element using any suitable processing equipment and conditions including conventional processing equipment and conditions (such as large processors or minilab processors). Generally, the processing equipment includes a series of tanks containing the various processing solutions in sequence. In most of such processing apparatus, the processed materials are generally immersed in the processing solutions. The volumes of the processing solutions can vary from less than 100 ml to 50 liters. Such processing equipment may also include rollers to guide the photographic material through the various processing tanks.

The bleaching and bleach-fixing compositions useful in this invention can be used as working tank solutions or replenishers, and can be in diluted or concentrated form for use as a regenerator and/or replenisher. The fixing solutions described above can be similarly prepared and used. All solutions can be replenished at a replenishment rate of up to 1000 ml/m$^2$. Replenishment can be accomplished directly into the processing tank, or a portion of overflow can be mixed with a regenerator to provide a suitable regenerated replenisher. The regenerator concentrate itself can be delivered directly to the processing tank.

Bleaching according to this invention can be carried out in less than 8 minutes. For example, the time may be within 6 minutes, and more preferably within 4 minutes. Preferably, at least 95% of the silver in the processed material is bleached during this bleaching time. Bleaching temperatures are generally from about 20 to about 50° C.

In some embodiments, bleaching can be carried out within from about 30 to about 90 seconds at from about 20 to about 50° C.

Fixing can be carried out within 4 minutes, and even shorter times may be desirable under certain conditions. Fixing temperatures can generally be from about 20 to about 50° C.

Bleach-fixing times and temperatures may be the same or vary from those noted above for bleaching and fixing but are readily known by those skilled in the art.

Each of the bleaching or bleach-fixing and fixing steps can be carried out in one or more tanks or stages arranged in countercurrent or concurrent flow. Any fixing method can be used, including immersing the element in the fixing composition (with or without agitation or circulation), bringing the element into contact with a web or drum surface that is wet in such a way that the fixing composition is brought into contact with the element, or by applying the fixing composition to the element by high velocity jet or spray.

During fixing, the fixing composition in the processor may accumulate dissolved silver halide, and other substances that are extracted from the processed photographic element. Such materials, and particularly silver halide, can be removed using known means, such as ion exchange, electrolysis, electrodialysis and precipitation.

Color negative photographic elements are also subjected to several other processing steps and compositions in order to provide the desired color negative image. The details of such processing steps and compositions are well known. For example, color negative processing also generally includes color development and post-fixing stabilizing and/or rinsing, and the color photographic elements processed therein, including emulsions, supports and other details thereof, are well known from hundreds of publications, some of which are listed in *Research Disclosure,* publication 38957, pp. 592–639, September 1996, incorporated herein by reference. *Research Disclosure* is a publication of Kenneth Mason Publications Ltd., Dudley House, 12 North Street, Emsworth, Hampshire PO10 7DQ England.

Preferably, the present invention is carried out to provide color negative images using a typical sequence of steps including color developing, bleaching, fixing, and stabilizing and/or rinsing. There may be various washing steps between steps. Many details of such processes are provided in incorporated herein by reference. Other details are provided in *Research Disclosure,* publication 38957 (noted above), and references noted therein.

Color negative films used in the practice of this invention are comprised of a support having thereon a plurality of photosensitive silver halide emulsion layers that can contain any conventional silver halide (or mixture thereof).

Useful supports are well known and include polyester films, polycarbonate films and cellulose acetate films. The silver halide layers include conventional binder materials, and other conventional addenda.

Some specific commercially available color negative photographic films that can be processed using this invention include, but are not limited to, KODAK ROYAL GOLD™ films, KODAK GOLD™ films, KODAK PRO GOLD™ films, KODAK FUNTIME™, KODAK EKTAPRESS PLUS™ films, EASTMAN EXR™ films, KODAK ADVANTiX™ films, FUJI SUPER G Plus films, FUJI SMARTFILM™ products, FUJICOLOR NEXIA™ films, KONICA VX films, KONICA SRG3200 film, 3M SCOTCH™ ATG films, and AGFA HDC and XRS films.

The color development is generally accomplished with a color developing composition containing the chemical components conventionally used for that purpose, including color developing agents, buffering agents, metal ion sequestering agents, optical brighteners, halides, antioxidants, sulfites and other compounds readily apparent to one skilled in the art. Examples and amounts of such components are well known in the art, including for example U.S. Pat. No. 5,037,725 (Cullinan et al), U.S. Pat. No. 5,552,264 (Cullinan et al), EP-A-0 530 921 (Buongiorne et al.), U.S. Pat. No. 5,508,155 (Marrese et al.), U.S. Pat. No. 4,982,804 (Vincent et al.), U.S. Pat. No. 4,482,626 (Twist et al.), U.S. Pat. No. 4,414,307 (Kapecki et al.), U.S. Pat. No. 4,876,174 (Ishikawa et al.), U.S. Pat. No. 5,354,646 (Kobayashi et al.), U.S. Pat. No. 4,264,716 (Vincent et al.), and U.S. Pat. No. 6,037,111 (Haye et al.), all incorporated herein by reference.

Useful preservatives in the color developing compositions include sulfites (such as sodium sulfite, potassium sulfite, sodium bisulfite and potassium metabisulfite), hydroxylamines and its derivatives, especially those derivatives having substituted or unsubstituted alkyl or aryl groups, hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. More particularly useful hydroxylamine derivatives include substituted and unsubstituted monoalkyl- and dialkylhydroxylamines (especially those substituted with sulfo, carboxy, phospho, hydroxy, carbonamido, sulfonamido or other solubilizing groups). Mixtures of compounds from the same or different classes of antioxidants can also be used if desired.

Examples of useful antioxidants are described for example, in U.S. Pat. No. 4,892,804 (noted above), U.S. Pat. No. 4,876,174 (noted above), U.S. Pat. No. 5,354,646 (noted above), U.S. Pat. No. 5,660,974 (Marrese et al.), U.S. Pat. No. 5,646,327 (Burns et al.), and U.S. Pat. No. 6,077,653 (McGarry), the disclosures of which are all incorporated herein by reference for description of useful antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

Most preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.), incorporated herein by reference.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Particularly useful color developing agents include aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. A most preferred color developing agent is KODAK Color Developing Agent CD-4 for the processing of color negative materials.

The color developing compositions can be buffered to a pH of from about 8 to about 12, and preferably from about 10 to about 11, using various known buffers including, but not limited to, carbonates, borates, and phosphates. A skilled worker would readily appreciate which buffers would be best for a given pH.

Single-phase, single-part color developing compositions may be useful as described in U.S. Pat. No. 6,077,651 (Darmon et al.). Useful, multi-part color developing compositions are described in U.S. Pat. No. 6,136,518 (Buongiorne et al.).

A final stabilizing and/or rinse composition generally has a pH of from about 5 to about 9 (in liquid form), and can include one or more surfactants (anionic, nonionic or both), biocides and buffering agents as is well known in the art. See for example, U.S. Pat. No. 3,545,970 (Giorgianni et al), U.S. Pat. No. 5,534,396 (McGuckin et al), U.S. Pat. No. 5,645,980 (McGuckin et al), U.S. Pat. No. 5,667,948 (McGuckin et al), U.S. Pat. No. 5,716,765 (McGuckin et al), EP-A-0 530 832 (Koma et al.), U.S. Pat. No. 5,968,716 (McGuckin et al.), U.S. Pat. No. 5,952,158 (McGuckin et al.), U.S. Pat. No. 3,676,136 (Mowrey), U.S. Pat. No. 4,786,583 (Schwartz), U.S. Pat. No. 5,529,890 (McGuckin et al.), U.S. Pat. No. 5,578,432 (McGuckin et al.), U.S. Pat. No. 5,534,396 (noted above), U.S. Pat. No. 6,022,764 (McGuckin et al.), and U.S. Pat. No. 6,040,123 (Maudhuit et al.), all of which are incorporated herein by reference.

All of the compositions useful in the practice of this invention can be provided in either working strength or concentrated form. If in the form of concentrates, suitable dilution before or during use would be readily apparent to one skilled in the art. They can also be provided in solid form, such as a solid tablet, powder, granules or pellets.

The following examples are provided to illustrate the invention, and not to be limiting in any fashion.

COMPARATIVE EXAMPLE 1

Effect of Phosphate Concentration

A concentrated photographic bleaching composition was prepared by adding in order:

250 ml of water
25 ml of ammonium hydroxide
29.1 g of PDTA
10.55 g of acetic acid
14.7 g of ammonium bromide
ammonium hydroxide, to pH 7
52.7 g of ferric nitrate (added as a 39% solution)
dilute ammonium hydroxide to pH 5.0, and
water to make final volume of 400 ml.

Several experiments were carried out to determine the amount of a phosphate required for precipitation of the Fe-PDTA bleaching agent. Eight ml aliquots of the concentrated bleaching composition were placed in vials along with various amounts of a 0.166 molar solution of sodium dihydrogen phosphate and enough water to make the total volume of each sample 10 ml. The final concentration of the Fe-PDTA bleaching agent in each sample was 0.17 mol/l.

After letting each sample stand 24 hours, the samples were examined to determine if any precipitate was formed. The concentrations of phosphate and the results are shown in TABLE I below.

TABLE I

| Sample | $NaH_2PO_4$ Concentration (mol/l) | Condition After 1-Day Standing |
|---|---|---|
| 1 | 0.000166 | Clear |
| 2 | 0.000332 | Clear |
| 3 | 0.000664 | Slightly cloudy |
| 4 | 0.00133 | Cloudy |
| 5 | 0.00199 | Cloudy |
| 6 | 0.00332 | Very cloudy |
| 7 | 0.00498 | Very cloudy |
| 8 | 0.00664 | Gelled |
| 9 | 0.00830 | Gelled |
| 10 | 0.00996 | Gelled |

EXAMPLES 1–11

Evaluation of Precipitation Prevention Additives

The concentrated bleaching composition shown above was used in the following precipitation experiments. For each experiment, 8 ml of the concentrated composition was placed in a vial along with 1 ml of a 0.12 mol/l solution of $NaH_2PO_4$ and the "additive" to be tested as indicated in TABLE II below. After mixing the samples, they were adjusted to about pH 5 if necessary using ammonium hydroxide. The concentration of phosphate in each sample was 0.012 mol/l.

In TABLE II, the last column describes the condition of the sample after standing for 1 day. Control A contained no "additive" and the precipitate formed after about 1 hour. Other Control samples contained "additives" outside the scope of the present invention. In the compositions used in this invention, the concentration listed in TABLE II is the approximate concentration of "additive" needed to prevent precipitation of Fe-PDTA for at least 5 days. Lower concentrations would also be effective perhaps for shorter periods of time. For the most effective "additives", the amount required to prevent precipitation for 1 day or longer was found to be at least 50% of the phosphate concentration. Thus, under the conditions used for these experiments, at least 0.006 mol/l of "additive" is needed for desirable results.

TABLE II

| Sample | "Additive" | Condition After 1-Day Standing |
|---|---|---|
| Control A | None | Gelled |
| Control B | 0.05 mol/l succinic acid | Gelled |
| Control C | 0.05 mol/l gluconic acid | Gelled |
| Control D | 0.05 mol/l hydroxyethylethylene-diaminetriacetic acid | Gelled |
| Example 1 | 0.09 mol/l citric acid | Clear |
| Example 2 | 0.05 mol/l tartaric acid | Clear |
| Example 3 | 0.1 malic acid | Clear |
| Example 4 | 0.02 mol/l 1-hydroxyethylene-1,1-diphosphonic acid | Clear |
| Example 5 | 0.013 mol/l 2-hydroxy-1,3-propylene-diaminetetraacetic acid | Clear |
| Example 6 | 0.03 mol/l 2-phosphonobutane-1,2,4-tricarboxylic acid | Clear |
| Example 7 | 0.02 mol/l iminodisuccinic acid | Clear |
| Example 8 | 0.05 mol/l ethylenediaminedisuccinic acid | Clear |
| Example 9 | 0.05 mol/l ethylenediaminetetra-(methylenephosphonic acid) | Clear |
| Example 10 | 0.025 mol/l morpholinomethanedisphosphonic acid | Clear |
| Example 11 | 0.05 mol/l hexamethylenediaminetetra-(methylenephosphonic acid) | Clear |

EXAMPLE 12

Bleaching of Color Negative Film

A bleaching composition useful in this invention was prepared by mixing the following:

| | |
|---|---|
| Water | 0.20 liters |
| Ammonium hydroxide | 50.00 ml |
| PDTA | 0.22 mol/l |
| Acetic acid | 21.10 grams |
| Ammonium bromide | 29.40 grams |
| Ammonium hydroxide | to pH 7 |
| Ferric nitrate (42% solution) | 92.16 grams |
| Iminodisuccinic acid, tetrasodium salt (32% solution) | 0.030 mol/l |
| Ammonium hydroxide or nitric acid | to pH 5.0 |
| Water to make | 1.00 liter |

This bleaching composition was used to process samples of imagewise exposed KODAK GOLD MAX 800 Film. The other processing steps and solutions used in this example were conventional C-41 processing solutions commercially available from Eastman Kodak Company, except as noted below. Color development was carried out using KODAK FLEXICOLOR Developer to which disodium phosphate had been added at a concentration of 0.13 mol/l.

Bleaching of the film samples was acceptable and no Fe-PDTA precipitation was evident in the bleaching composition. The desired color negative image was obtained and appeared identical to the image on a sample of the same film that had been processed using the conventional C-41 process conditions and processing solutions.

The invention has been described in detail with particular reference to preferred embodiments thereof, but it will be understood that variations and modifications can be effected within the spirit and scope of the invention.

We claim:

1. A method of photographic processing comprising bleaching or bleach-fixing an imagewise exposed and color developed color negative photographic silver halide element with a photographic bleaching or bleach-fixing composition that in aqueous form has a pH of at least 4 and comprises:

a) at least 0.01 mol/l of a bleaching agent that comprises ferric ion chelated with 1,3-propylenediaminetetraacetic acid or a salt thereof, b) at least 0.005 mol/l of an organic polyphosphonic acid, an aminopolysuccinic acid, or a polycarboxylic acid containing at least one hydroxy group as a compound to prevent bleaching agent precipitation, and c) at least 0.0005 mol/l of inorganic phosphate ions that are introduced directly to said bleaching or bleach-fixing composition or by carryover.

2. The method of claim 1 wherein said bleaching agent precipitation prevention compound is present in an amount of from about 0.01 to about 0.5 mol/l.

3. The method of claim 1 wherein said bleaching agent precipitation prevention compound is an amninopolyphosphonic acid or a hydroxy-substituted polyphosphonic acid, or a salt of any of these.

4. The method of claim 1 wherein said bleaching agent precipitation prevention compound is 1-hydroxyethylidene-1,1-diphosphonic acid, ethylenediaminetetra (methylenephosphonic acid), morpholinomethanediphosphonic acid, hexamethylenediaminetetra-(methylenephosphonic acid), diethylenetriaminepenta (methylenephosphonic acid), 2-hydroxy-1,3-propylenediaminetetraacetic acid, hydroxyaspartic acid, citric acid, tartaric acid, malic acid, citramalic acid, hydroxymalonic acid, iminodisuccinic acid, ethylenediaminedisuccinic acid, or dihydroxyfumaric acid, a salt of any of these, or mixtures of any two or more of these.

5. The method of claim 1 wherein said bleaching agent precipitation prevention compound is iminodisuccinic acid.

6. The method of claim 1 comprising ferric ions in an amount of from about 0.01 to about 1 mol/l.

7. The method of claim 1 further comprising a buffer and has a pH of from about 4 to about 8.

8. A method of photographic processing comprising bleaching an imagewise exposed and color developed color negative photographic silver halide film with photographic bleaching composition that in aqueous form has a pH of from about 5 to about 7 and comprises:

a) from about 0.1 to about 0.4 mol/l of a bleaching agent that comprises ferric ion chelated with 1,3-propylenediaminetetraacetic acid or a salt thereof, b) from about 0.01 to about 0.5 mol/l of a bleaching agent precipitation prevention agent that is 1-hydroxyethylidene-1,1-diphosphonic acid, ethylenediaminetetra-(methylenephosphonic acid), morpholinomethanediphosphonic acid, hexamethylenediaminetetra-methylenephosphonic acid), diethylenetriaminepenta(methylenephosphonic acid), 2-hydroxy-1,3-propylenediaminetetraacetic acid, hydroxyaspartic acid, citric acid, tartaric acid, malic acid, citramalic acid, hydroxymalonic acid, iminodisuccinic acid, ethylenediaminedisuccinic acid, or dihydroxyfumaric acid, a salt of any of these, or mixtures of any two or more of these, and c) at least 0.0005 mol/l of inorganic phosphate ions that are introduced directly to said bleaching composition or by carryover.

9. The method of claim 8 wherein said bleaching agent precipitation prevention agent is iminodisuccinic acid, or a salt thereof.

10. The method of claim 1 wherein said bleaching of at least 95 % of the silver is carried out for from about 60 to about 360 seconds at from about 25 to about 50° C.

11. The method of claim 1 wherein said imagewise exposed and color developed color negative photographic silver halide element is processed using said photographic bleaching composition after color development and then said element is fixed using a photographic fixing composition.

12. The method of claim 1 wherein said bleaching is carried out for from about 30 to about 90 seconds at from about 25 to about 50° C.

* * * * *